US005709897A

United States Patent [19]

Pearlstein

[11] Patent Number: 5,709,897

[45] Date of Patent: Jan. 20, 1998

[54] ABSORBENT PACKAGING FOR FOOD PRODUCTS

[76] Inventor: Leonard Pearlstein, 1441 Waverly Rd., Gladwyn, Pa. 19035

[21] Appl. No.: 527,672

[22] Filed: Sep. 12, 1995

[51] Int. Cl.[6] ..... B65D 85/00

[52] U.S. Cl. ..... 426/106; 426/124; 426/129; 426/396; 206/204

[58] Field of Search ..... 426/106, 124, 426/127, 129, 396; 206/204

[56] References Cited

U.S. PATENT DOCUMENTS

| | | | |
|---|---|---|---|
| 3,209,978 | 10/1965 | Dupuis | 426/124 X |
| 3,575,287 | 4/1971 | Graveley | 426/124 X |
| 3,885,727 | 5/1975 | Gilley | 426/124 X |
| 3,939,135 | 2/1976 | Hwa et al. | 260/87.1 |
| 4,275,811 | 6/1981 | Miller | 426/124 X |
| 4,321,997 | 3/1982 | Miller | 426/124 X |
| 4,342,314 | 8/1982 | Radel et al. | 128/287 |
| 4,463,045 | 7/1984 | Ahr et al. | 428/131 |
| 4,756,939 | 7/1988 | Goodwin | 428/74 |
| 4,940,621 | 7/1990 | Rhodes et al. | 428/137 |
| 5,002,942 | 3/1991 | Yanagisawa et al. | 514/211 |
| 5,055,332 | 10/1991 | Rhodes et al. | 428/74 |
| 5,176,930 | 1/1993 | Kannankeril et al. | 426/124 |
| 5,370,895 | 12/1994 | Doerter | 426/573 |
| 5,552,169 | 9/1996 | Kannankeril et al. | 426/129 X |

*Primary Examiner*—Milton Cano
*Attorney, Agent, or Firm*—Howson & Howson

[57] ABSTRACT

In a package for food products having a tendency to exude liquids, an absorbent pad underlying the food product in a tray is made up of an absorbent layer underneath a layer of polyethylene film having an array of elongated, thermoformed apertures. These apertures efficiently transport liquid into the absorbent layer and resist reverse flow when pressure is applied to the absorbent pad, thereby making it possible to utilize a paperboard tray. The absorbent layer and apertured polyethylene film can be laminated together with a paperboard base layer, and the laminate can then be die cut and folded to form a tray made up entirely of the laminate and having its bottom and side walls lined with the absorbent material and apertured film.

11 Claims, 4 Drawing Sheets

ABSORBENT PACKAGING FOR FOOD PRODUCTS

BACKGROUND OF THE INVENTION

This invention relates to absorbent articles and the use of such articles in the control of fluid exudate present in packaged food products.

It has been found desirable for retail stores to display food items in individually wrapped packages. In the case of certain foods such as meat, poultry, fish and certain fruits and vegetables, consumers prefer to make purchase decisions based upon such factors such as appearance, price, weight, etc.

Liquid-containing food products, for example those mentioned above are therefore packaged in disposable trays in plastic or paperboard covered with transparent wrapping.

An important disadvantage of this packaging concept is that liquids exuding from such food products, for example blood exuding from meat, tend to accumulate in the package causing an unsightly appearance and an environment supportive of the growth and proliferation of microorganisms, including dangerous pathogens.

Attempts have been made to control these liquids, some of which are used commercially and/or described in printed publications. Generally, these methods include the use of an absorbent pad positioned between the food product and the tray. As discussed below, these attempts do not adequately control exuded liquid because they fail to meet one or more of the following requirements:

1. The absorbent medium must rapidly absorb liquid exudate both when the packaged product is stored horizontally as well as on an inclined shelf in the store.
2. The absorbent medium must isolate liquid from the product both visually and physically and retain the liquid under the weight of the food product, which may, in certain instances, be as much as several pounds.
3. The absorbent medium should not detract from the visual presentation of the product nor add substantial cost.
4. The absorbent medium must lend itself to high speed automation, where appropriate.
5. The absorbent medium should be an adjunct to increased shelf life and to the retardation of spoilage.

Absorbent media disclosed in the prior art have been composed of a fibrous layer or absorbent core of pulp confined between upper and lower layers of plastic film, the upper layer being in direct contact with the food product and the lower layer being positioned on the bottom of a plastic or paperboard tray.

In U.S. Pat. No. 4,756,939 (Goodwin) both the upper and lower layers are imperforate and impervious to liquid. However, these layers and the absorbent intermediate layer are joined in such a way as to form side boundary film which is perforated. Thus, liquids exuding from the food product run off the top film, accumulate in the tray edge and them migrate into the absorbent medium through the side perforations.

U.S. Pat. Nos. 5,055,332 and 5,002,945 disclose an absorbent core comprising pulp, superabsorbent granules, and a heat-bondable synthetic fiber. The upper film and/or the lower film are perforated. The presence of superabsorbent polymer increases liquid holding capacity and retention under pressure.

In alternate design to absorb fluids accumulating in the tray corners and edges a portion of an absorbent core extends beyond the sealed edges of upper and lower plastic layers. This approach, disclosed in the U.S. Pat. No. 5,176,930 (Kannankeril), is intended to provide higher wicking rates.

U.S. Pat. No. 5,320,895 (Larsonneur) discloses a technique for improving the rate of wicking in which a series of perforating pins create holes in the film with tufts of tissue projecting outwardly from the core.

U.S. Pat. No. 4,275,811 (Miller) discloses an absorbent pad for food packaging comprising an imperforate upper film layer and a perforated lower film layer, with an absorbent layer between them. In this case, liquid runs off the upper film layer, accumulates in the tray bottom and them migrates through the openings in the lower film. According to the Miller patent, the bottom sheet includes a plurality of minute openings which permit the passage of a liquid from the tray bottom wall into the absorbent material. The openings are distributed substantially uniformly over the full area of the sheet and typically have a density of between about 15 and 100 per square inch, and preferably between about 80 and 90 per square inch. In this regard the openings 24 may be formed by a perforating operation, such as by contacting the film with a roll covered with pins having a diameter of about 0.01 inches, and of the type used in textile carding cloth. Such perforating operation results in the openings having a diameter of about 0.01 inches, and peripheral portions which extend outwardly from the sheet. According to the Miller patent, the sheet is oriented so that the peripheral portions of the openings extend toward the absorbent mat to retard the passage of liquid outwardly from the mat and through the sheet.

Devices for absorbing liquid food exudate disclosed in prior art are deficient in performing needed functions, as listed above, in at least one respect. For example, perforations in the plane of the upper or lower film layer do not provide a mechanism to prevent the reverse migration of liquid out of the absorbent medium particularly when the medium is subjected to compression under the weight of the food product. The absorbent pad described in Miller U.S. Pat. No. 4,275,811, retards reverse migration of liquid to some extent, but is still subject to reverse migration when pressure is applied to the pad.

Perforations made by puncturing a film need to be spaced apart from one another by a distance sufficient to prevent the film from tearing. Consequently, the puncturing process places limitations on the size and density of the perforations, with resulting limitations on the rate at which liquids can be absorbed through the punctured film.

In the cases in which the upper film in contact with the food product is imperforate and impervious to liquid flow, exudate tends to pool on the film surface until the package is tilted so that the liquid can run off.

It was in recognition of above functional deficiencies in the control, containment, and isolation of liquid exudate by devices presently known, that the instant invention was conceived and reduced to practice.

SUMMARY OF THE INVENTION

An important object of this invention is to provide a package for liquid-containing foods such as meats, poultry, and fish, which controls the flow and accumulation of exuded liquids, such as blood, so that the liquids are physically and visually isolated from the food product.

Still another object of the invention is to provide a package for liquid-containing foods, having an absorbent pad with improved resistance to reverse migration of exudate outwardly from the absorbent layer.

Still another object of the invention is to provide a less expensive package for liquid-containing foods which has the ability to absorb liquid exudate effectively.

In accordance with the invention, a package containing a food product having a tendency to exude liquid, includes an absorber comprising a core of absorbent material disposed between first and second layers made of substantially liquid-impervious material. The first layer is a film having an inner surface facing the core and an outer surface, and at least part of the first layer has a plurality of apertures with sidewalls projecting from the inner face toward the core. The sidewalls have terminating edges remote from the inner surface of the first layer and in contact with the core. The aperture walls are formed by stretching the film, preferably with the application of heat, to cause the lengths of the sidewalls of the apertures to be at least approximately five times the thickness of the first layer measured from its inner surface to its outer surface, and preferably so that the sidewalls of the apertures decrease in thickness in the direction away from the inner surface of the first layer from a thickness substantially the same as the thickness of the first layer, to a thickness less than approximately 0.0005 inch. The apertures so formed in this manner rapidly conduct liquid exuded by the food product to the absorbent core, and resist flow of liquid from the core outwardly through the apertures when pressure is applied to the core by the weight of the food product or by the weight of food packages stacked one on top of another.

Preferably, the outer surface of the apertured first layer is in contact with the food product. However, the second layer can also have apertures. For example, in the case of an absorber located on the bottom wall of a meat tray, underneath a piece of meat, the absorber can have an upper apertured film layer in contact with the meat and a lower film layer in contact with the tray bottom and also having apertures to pick up any exudate which reaches the bottom of the tray.

In an alternative embodiment of the invention, the second layer underlying the absorbent core is a film substantially free of perforations and adhesively fixed to the tray.

In a further alternative embodiment, the second layer is free of apertures and comprises liquid-impervious paperboard or paperboard covered by a liquid-impervious film. The second layer, the core of absorbent material and the first layer are laminated together and in the form of a die-cut sheet folded into a tray having a bottom and side walls with inwardly facing surfaces. The first layer serves as a liner defining the inwardly facing surface of the bottom and at least part of the inwardly facing surfaces of the side walls of the tray.

Further objects, details and advantages of the invention will be apparent from the following detailed description, when read in conjunction with the drawings.

DETAILED DESCRIPTION

Figure 1:
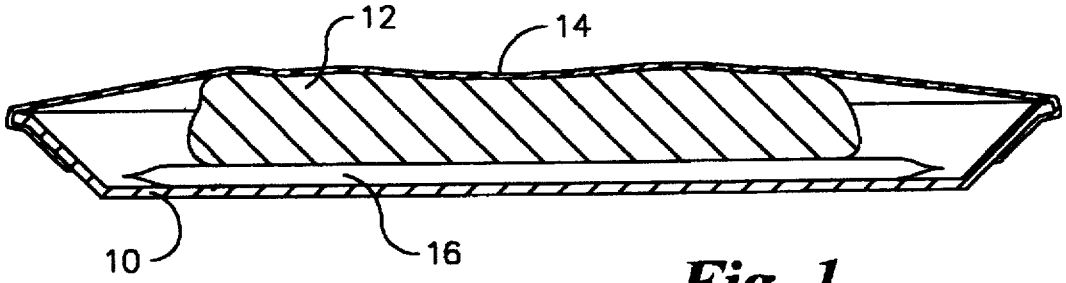
FIG. 1 is a vertical section of a meat packaging tray in provided with an absorbent pad in accordance with the invention.

FIG. 1 shows a meat packaging tray 10, which is typically formed of expanded polystyrene. Within the tray, is a portion 12 of a liquid-containing food, such as meat, fish or poultry. A transparent, self-adhering film 14, typically of polyvinylidene chloride is stretched over the food portion and around the edges of the tray to form an enclosure. Underneath the food portion 12, is an absorbent pad 16. Preferably, the absorbent pad covers at least 75% of the area of the bottom of the tray.

Figure 2:
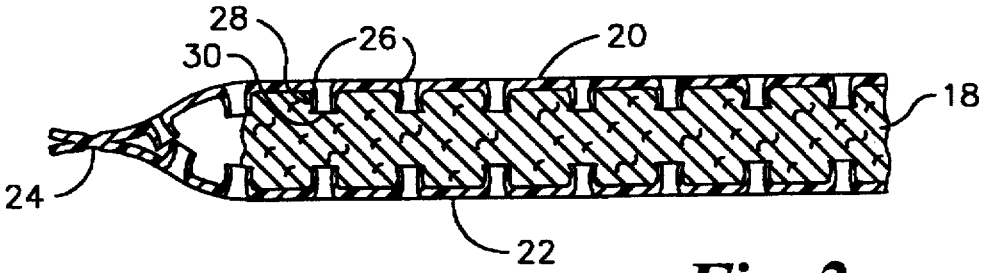
FIG. 2 is a fragmentary sectional view of the absorbent pad of FIG. 1.

The pad 16, as shown in FIG. 2, comprises an absorbent layer 18, enclosed in an envelope consisting of upper and lower layers 20 and 22 of apertured film. The upper and lower film layers are heat-sealed together at the periphery of the pad, the seal being shown at 24 in FIG. 2.

Each of the upper and lower layers 20 and 22 consists of a formed film composed of a mixture of low density polyethylene and high density polyethylene, and is preferably approximately 1.0 mil (0.001 inch) in thickness. Suitable films are disclosed in U.S. Pat. Nos. 3,929,135 (Thompson) and 4,463,045 (Ahr et al.), both incorporated herein by reference. Formed films of this type are often referred to in the art as "macroscopically expanded, three-dimensional plastic webs."

Typically these formed film have a plurality of openings or apertures arranged in a repeating pattern on the film surface. The openings can be of various geometrical shapes, for example pentagons, hexagons or other polygons, circles or ellipses. Two or more different opening configurations can be combined in a given film. Typical patterns are disclosed in U.S. Pat. No. 4,342,314 (Radel et al.)

Figure 3:
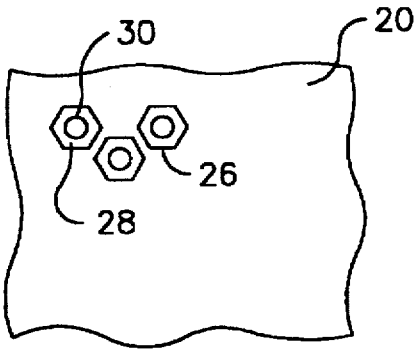
FIG. 3 is a fragmentary plan view showing the pattern of apertures in the upper and lower sheets of the absorbent pad of FIG. 2.

FIG. 3 shows that the apertures of film 20 have a generally hexagonal shape. Each opening has a sidewall 28 which extends away from the film surface into the absorbent layer 18, as shown in FIG. 2. The sidewalls form tapered passages with somewhat irregularly shaped end openings 30. In some cases, the passages are substantially conical. In others, as in FIG. 2, the passages may narrow and then widen, proceeding away from the surface of the film.

A suitable method of preparing the formed film of the invention comprises the steps of extruding a cast film of a polyolefin, preferably polyethylene, at a desired thickness in the range of about 0.5 mil to 3.0 mil. A dispersed pigment may be included in the polyolefin to impart color and opacity to the film. Following extrusion, the film is cooled and wound up.

The film is then wrapped onto a drum-shaped screen containing a pattern of openings corresponding to the desired pattern of apertures to be formed in the film. Heat is applied to soften the film, typically by directing jets of hot air toward the film from the exterior of the drum-shaped screen. At the same time, the film is subjected to a vacuum drawn through the screen openings. The vacuum causes the film to be drawn into the screen openings and rupture, thereby forming the three-dimensional apertured film as shown in FIGS. 2 and 3. After a cooling step, the three-dimensional apertured film is slit to the desired width and wound.

In a modification of the above-described process, extruded film is applied to the screen while still in a hot condition from the extrusion process, and the openings are formed by applying a vacuum to the film through the screen openings.

In the formation process, the combined effects of heat and pressure cause the film to soften and stretch uniformly until the film breaks. The formation process produces three-dimensional openings having a generally uniform shape. Typically, the film stretches to a sidewall length at least 5 times the starting thickness of the film and preferably at least 10 times the starting thickness. Thus, by way of illustration, apertures formed from a 1.0 mil. film having sidewalls extending away from the plane of the film which are at least about 5 mil in length and more often about 10 mil in length, the length of the sidewall of an aperture being measured along the contour of the inside wall from one end opening of an aperture to the other end opening. At the same time, as the film stretches in the formation of the apertures, the thickness of the sidewalls decreases so that the thickness of the sidewalls decreases in a direction proceeding away from the inner face of the film, preferably from a thickness substantially equal to the front-to-back film thickness to a thickness less than one fourth of the front-to-back film thickness. For example, with a film having a front-to-back thickness of 1.0 mil., the sidewalls of apertures having a length of 5.0 mils will be tapered down to an extremely small thickness, typically less than 0.5 mils.

These apertures are typically 0.02 inch at their narrowest point, much larger than the largest practical opening in a film of the kind in which openings are formed by puncturing. The minimum opening can be made somewhat larger than 0.02 inch, but at significantly larger dimensions, the film is no longer able to resist reverse flow of liquid effectively.

Typically, the density of the apertures is 200 per square inch, but the density of the openings in a practical apertured film can range from about 100 to 600 per square inch.

The absorbent layer 18 preferably consists of fibers or fiber assemblies having the ability to absorb liquid flowing through the three-dimensional apertures of the formed film. Suitable fibers include cellulose pulp, rayon, selected synthetic fibers with hydrophilic surface treatments, and naturally occurring fibers, for example, peat moss.

The fibers are preferably present in the absorbent layer in the form of fluff wadding, tissue, creped tissue, paper, or nonwoven sheet material. In one embodiment, the absorbent layer is composed of multiple layers of creped tissue. In a preferred embodiment of the invention, the absorbent layer is composed of an air-laid or dry-formed web of pulp fibers bonded with latex polymer or alteratively with a thermoplastic bonding fiber.

Optionally, the fiber core may contain a quantity of superabsorbent polymer in the form of granules, fiber, or film. The superabsorbent polymer should be present at a ratio of polymer to fiber in the range of about 1:10 to about 1:1.

As shown in FIG. 2, the apertures extend into the absorbent layer and their end openings are in intimate contact with the absorbent material. This insures that liquid which flows through the apertures is efficiently absorbed in the absorbent layer.

The thickness of the absorbent pad of FIG. 2 may vary depending upon the food product contained in the package, the tray depth, and the nature of the fluids exuded. Usually the pad will be at from about 10 mil. to about 500 mil. thick. The geometric shape normally follows the shape of the tray, which in most instances is rectangular or square. While the pad will usually be large enough to cover at least about 75% of the tray bottom area, in certain instances, the pad may be larger in area than the tray bottom so that a portion of the pad extends upwardly to cover at least part of the inner faces of the side walls of the tray. For example, the absorbent pad can be arranged to extend half-way up the side walls of the tray.

In the embodiment shown in FIGS. 1 and 2, the absorbent pad has apertured film both on its top side and on its bottom side. Liquid exudate which happens to flow past the edges of the absorbent pad, for example due to tilting of the package, will be absorbed by the absorbent layer through the openings in the lower apertured film layer. However, if desired, and especially in the case of an absorbent pad which covers substantially all of the bottom of the tray, the lower film layer can be an imperforate layer, thereby reducing the cost of the absorbent pad.

One of the advantages of the invention is that the apertures in the film provide improved absorbency and resistance to outward flow of liquid when pressure is applied to the pad. The improved absorbency and resistance to outward flow prevent the accumulation of liquid on the bottom of the tray and allow the tray to be made from paperboard instead of expanded polystyrene. This results in a reduction in the cost of the packaging, and also has advantages in terms of environmental impact. Suitable paperboard has a basis weight of from about 9 lb./ream to about 200 lb./ream and may be composed of a single layer or a multilayered laminate.

Figure 4:
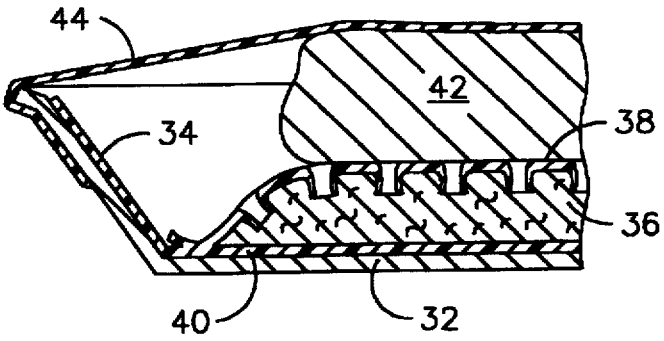
FIG. 4 is a fragmentary sectional view of a meat packaging tray in accordance with an alternative embodiment of the invention.

In the alternative embodiment shown in FIG. 4, a paperboard tray 32 is lined with an imperforate sheet 34 of polyethylene film, which is adhesively secured to the bottom and sidewalls of the tray. An absorbent layer 36, similar to layer 18 in FIG. 2, is disposed on top of film layer 34, and a layer 38 of apertured film lies on top of the absorbent layer. The apertured layer 38 is heat-welded to the lower imperforate layer 34 at 40, along a line surrounding the absorbent layer. Optionally, gaps can be provided in the heat weld to allow flow of liquid laterally into the absorbent layer from the area surrounding the absorbent layer. A food product 42 lies on top of the apertured film layer 38 and is enclosed underneath a polyvinylidene chloride sheet 44. Preferably the paper board tray has a basis weight from about 9 lb/ream to about 200 lb/ream. The layer of film attached to the inner surface of the paper board tray preferably has a thickness in the range from about 0.5 mil. to about 3.0 mil. In this embodiment, the paperboard tray is fully protected from contact with liquid.

Figure 5:
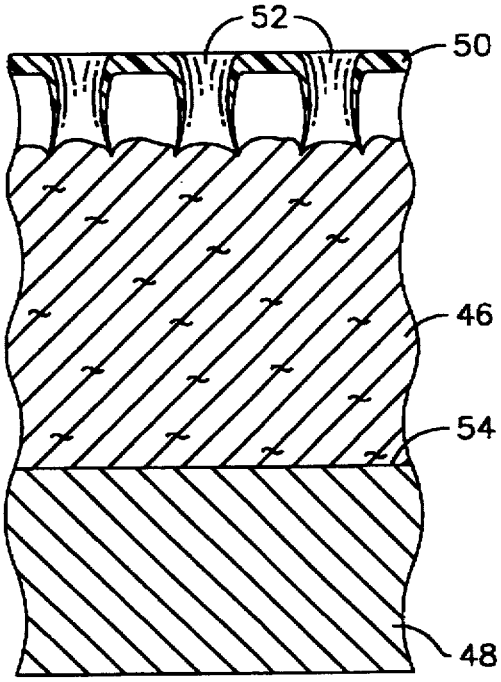
FIG. 5 is a fragmentary sectional view of a laminate in accordance with the invention, from which a food packaging tray can be formed.

FIG. 5 illustrates a laminate in accordance with still another alternative embodiment of the invention. In this embodiment, an absorbent fibrous layer 46 is sandwiched between a paperboard base layer 48 and a film 50 having heat-formed apertures 52, forming a laminate which can be used to make a food packaging tray. The face 54 of paperboard layer 48 has a liquid-impermeable or liquid-repellent coating or is impregnated with a liquid-repellent material. The layers are secured together by adhesive bonding, and the fibrous layer 46 is preferably one having a relatively high tensile strength, e.g. an air-laid fibrous material in which the fibers are bonded together where they cross one another.

Figure 6:
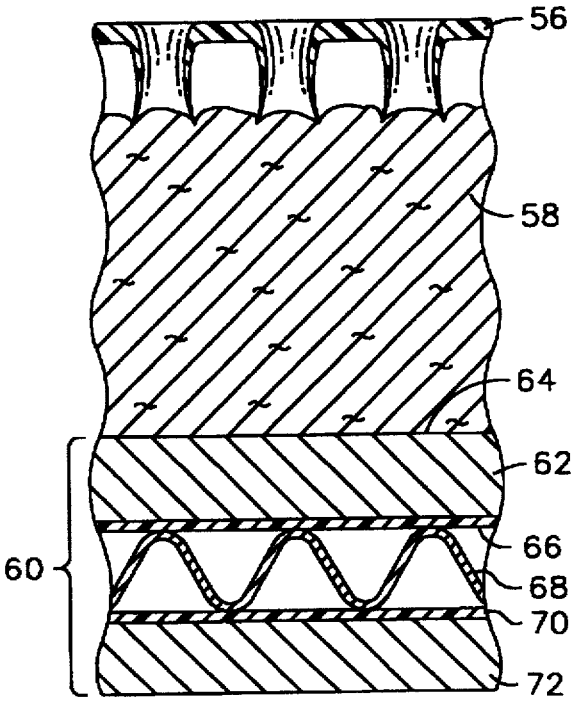
FIG. 6 is a fragmentary sectional view of an alternative to the laminate of FIG. 5.

FIG. 6 shows an alternative laminate comprising an apertured film 56, an absorbent fibrous layer 58, and a composite base layer 60. The composite base layer comprises a first paperboard layer 62 a liquid-impermeable or liquid-repellent coating on its face 64 or impregnated with a liquid-repellent coating. A film 66 of polyethylene is adhesively secured to the underside of layer 62, and a corrugated paperboard layer 68 is adhesively secured to layer 66. Underneath the corrugated layer, is a second polyethylene film layer 70 and another paperboard layer 72, similar to layer 62.

Figure 7:
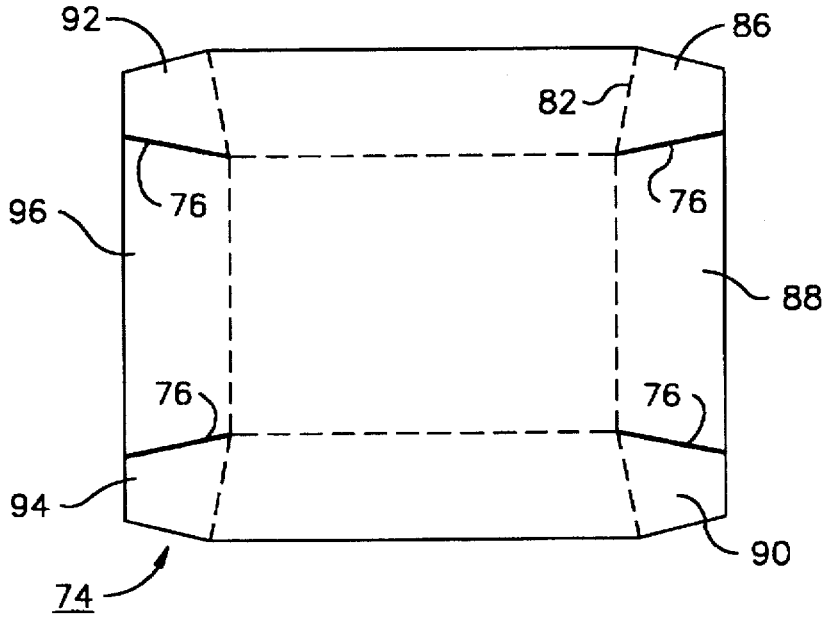
FIG. 7 is a plan view of a die-cut laminate of the kind shown in FIG. 5, with cuts shown in solid lines, and with broken fold lines.
Figure 8:
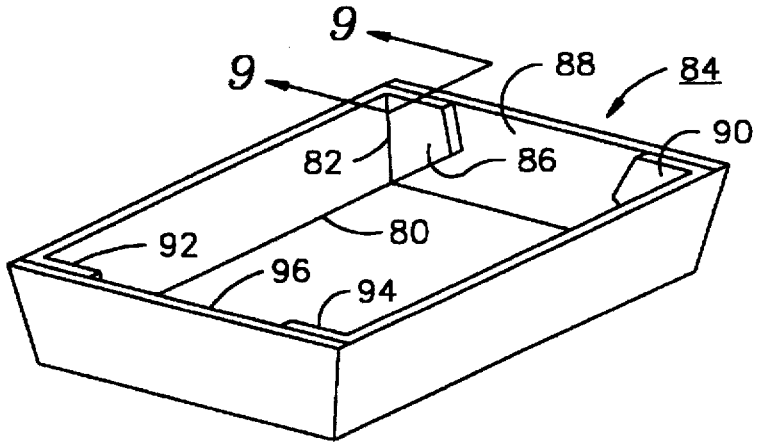
FIG. 8 is a perspective view of a tray formed from the die-cut laminate of FIG. 7.

Either of the laminates in FIGS. 5 and 6 can be used to form the tray depicted in FIGS. 7 and 8.

A continuous sheet of the laminate is die cut into a sheet 74 having the configuration shown in FIG. 7, in which the die-cutting step forms not only the borders, but also the cuts 76, which extend inwardly from the border. The sheet is folded along the fold lines, e.g. 80 and 82, to form the tray 84 shown in FIG. 8. The tab 86, defined between a fold lines 82 and a cut 76 is adhesively secured to the inside face of panel 88, which is defined between two cuts 76. Tab 90 is similarly secured to panel 88 and tabs 92 and 94 are similarly secured to panel 96.

Figure 9:
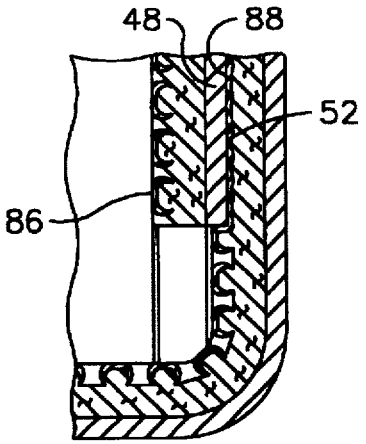
FIG. 9 is a vertical section of a corner of the tray, taken on the plane 9—9 indicated in FIG. 8.

FIG. 9 shows that tab. 86 is secured to the inside face of panel 88. Since the elements of the laminate from which the tray is formed are all adhesively secured together, and the absorbent fiber layer has a relatively high tensile strength, it is possible to use adhesive to secure the paper layer 48 of a tab directly to the apertured film layer 52 of a panel and to form a joint which will withstand the forces normally encountered in handling without coming apart.

A tray similar to that depicted in FIGS. 7, 8 and 9 can be made from the laminate of FIG. 6.

Figure 10:
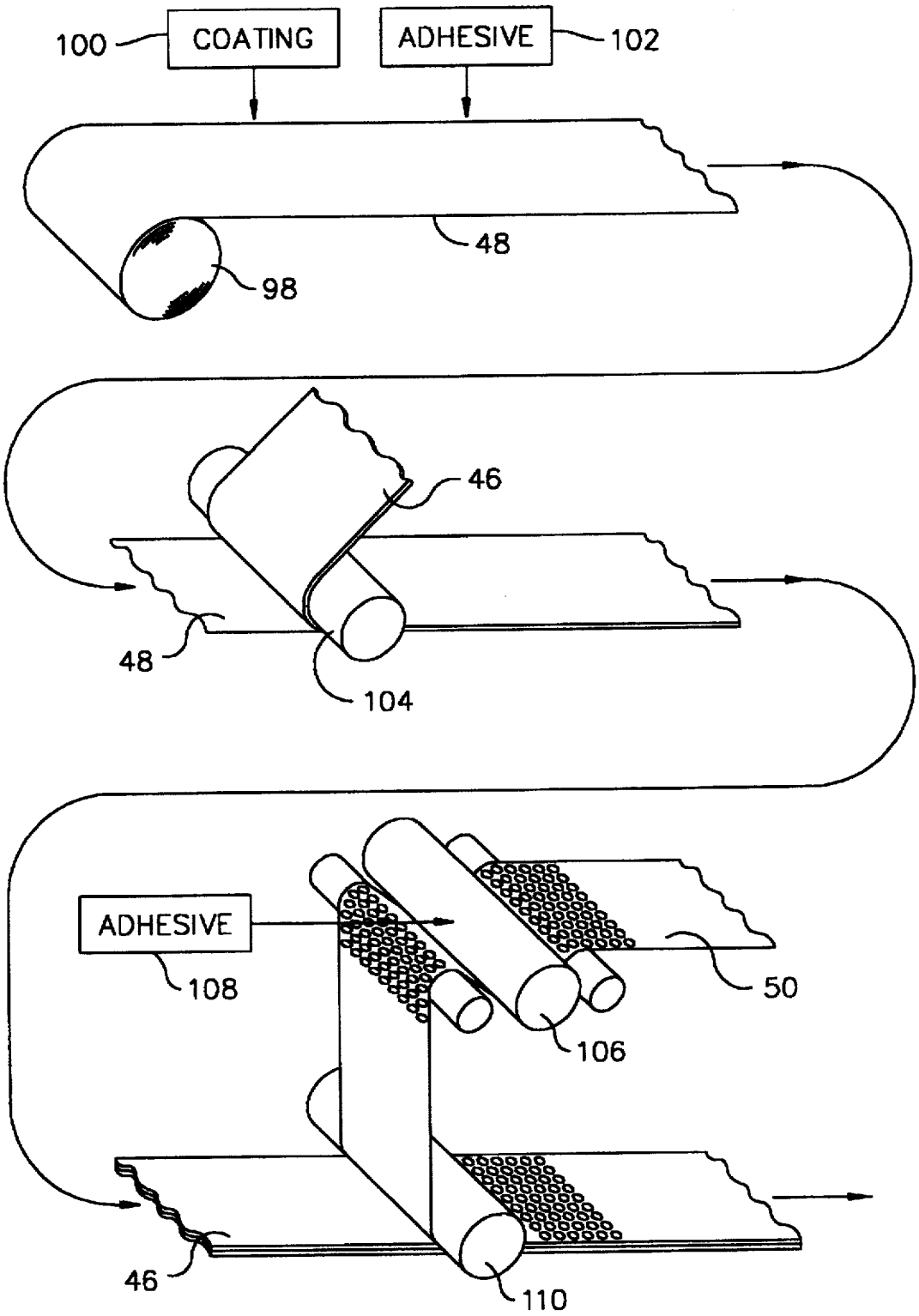
FIG. 10 is a schematic view illustrating a process for making the laminate of FIG. 5.

FIG. 10 shows the process of making the laminate of FIG. 5. Paperboard 48, supplied from a roll 98, is coated with polyethylene or another liquid-impervious or liquid-repellent coating by coating sprayer 100. Following coating, an adhesive is applied by sprayer 102. The absorbent layer 46 is fed onto layer 48 underneath roller 104. The apertured film 50 is fed underneath an adhesive-applying roller 106 with its apertures extending toward the roller so that the adhesive from supply 108 is applied primarily to the ends of the aperture openings. The film, with adhesive applied to it, is fed onto the absorbent layer 46 underneath roller 110 to produce the finished laminate.

Instead of forming the laminate with absorbent material and apertured film covering the entire face of the paperboard layer, the absorbent material and apertured film can be supplied in widths narrower than that of the paperboard layer, in order to leave a border of paperboard which can be formed into tabs and panels. These paperboard tabs can then be adhesively secured directly to the paperboard panels. While this alternative will ordinarily leave some parts of the inside walls of the tray uncovered by absorbent material, it has the advantage that it allows paperboard to be glued directly to paperboard, making it unnecessary to use a high tensile strength absorbent.

EXAMPLES

Example 1—Illustrative

An intermediate layer of absorbent core was placed above an imperforate polyethylene film 1.0 mil. thick and below a three-dimensionally apertured formed film of polyethylene also 1.0 mil thick.

The absorbent core contained four layers of creped tissue, each layer having a thickness of from about 9 to 13 mil.

The apertured film had a pattern of openings in the form of circles and ellipses, with approximately 400 openings per square inch. The configuration of the circles and ellipses was substantially as shown in U.S. Design Pat. No. D362,120, issued Sep. 12, 1995. The circles were approximately 0.73 to 0.8 mm in diameter in the plane of the top surface of the film and the ellipses were approximately 1.2 mm long and 0.6 mm wide in the same plane. The side walls of the apertures, produced by the stretching which took place in the formation of the apertures, were approximately 7 mils long, measured along their contours. The sidewalls were shaped so that each aperture narrowed and then widened, proceeding from one of its ends to the other. The open area, referring to the narrowest parts of the apertures, was approximately 25% of the total area of the film in the plane of the top surface.

The thickness of the sidewalls decreased from approximately 1.0 mil near the top face of the film to approximately 0.5 mil near the openings remote from the top face of the film.

The apertured film was positioned on the core layers so that the edges of the aperture openings were in contact with the creped tissue.

Example 2—Comparative

The multilayer construction of Example 1 was repeated using an apertured polyethylene film known in the prior art. The film was about 1.0 mil thick and contained about 100 holes per square inch. The holes did not have elongated side walls and were of the kind formed by puncturing, as described in Miller U.S. Pat. No. 4,275,811. The absorbent core and imperforate layer were identical to the core and imperforate layer in Example 1.

The Absorbent pads of examples 1 and 2 were evaluated in laboratory tests for their ability to absorb liquid (absorbency rate test) and to retain absorbed liquid with the core under a load (rewet test).

Absorbency rate was determined by using a 4 inch by 4 inch block of methyl methacrylate polymer having a one inch diameter cylindrical opening in its center, a dyed 1% saline solution, a graduated cylinder and a stopwatch capable of recording elapsed time and graduated in 0.1 second intervals.

In the absorbency rate test, the absorbent pad was laid flat so that it was free from wrinkles and folds, with the apertured film layer facing upward. The cylinder block was placed on the center of the pad. 10 ml. of the saline solution was poured from the graduated cylinder through the opening in the block onto the surface of the pad and the stopwatch was started immediately. The solution was allowed to flow into the pad and the stopwatch was stopped as soon as the solution was completely absorbed. The absorption time was determined for each of five specimens to the nearest 0.1 second, and averaged.

The rewet test was carried out using the same 4 inch by 4 inch block and the same dyed 1% saline solution, a VWR filter paper of grade #417, 9 cm. in diameter, a 4 inch by 4 inch square plate of clear methyl methacrylate polymer, having a thickness of ⅛ inch and weighing 50 grams, a 2.2 kg. weight a 25 ml. cylinder and a top loading electronic balance accurate to ±0.01 g.

In the rewet test, five absorbent pads were prepared for testing by placing them flat on a level surface with the apertured film layer facing upward. The block was centered on the apertured film layer of each pad and 10 ml of the 1% saline solution was poured into the opening of the cylinder block. After the solution was completely absorbed, the cylinder block was removed and the pad was allowed to stand for five minutes. At the end of the five minute interval, ten sheets of weighed filter paper were placed simultaneously on the center of the pad followed by the square plate and the 2.2 kg. weight. This places a pressure on the pad of approximately 0.5 psi. The filter paper, square plate and weight were left in position for fifteen seconds. The plate was removed and the filter paper was weighed. The rewet for each pad was determined by subtracting the initial weight of the ten sheets of filter paper from the measured weight. The rewets for each of the five samples were averaged.

Results of the evaluation are shown in the following table.

| | Absorbency Rate (Seconds) | Rewet (grams) |
|---|---|---|
| Example 1 | 4 | 0.1 |
| Example 2 | 22 | 1.9 |

The pads of Example 1 absorbed fluid from the outer surface faster than Example 2 by a factor of about 5–6. However, in Example 1 the rate of release back to the surface was only about 5% that of Example 2. Thus, the absorbent pad of the invention proved to be remarkably superior both in absorbency and retention. These results clearly illustrate the unique and desirable performance of the invention in the control of liquid exudate. The absorbent structure not only absorbs liquids at a rapid rate and retains the absorbed liquid under load; it effectively isolates and contains the liquids both visually and physically.

The tests compared the absorbent pad in accordance with the invention to an absorbent pad similar to the pad described in U.S. Pat. No. 4,275,811, especially in regard to the structure and configuration of the apertured film. The differences between the apertured film in U.S. Pat. No. 4,275,811 and the apertured film of this invention is that the former had holes formed by puncturing, whereas the holes in the film of this invention were "thermoformed", i.e. formed by the application of heat and pressure.

The puncturing process forms tears in the peripheries of the openings, and does not cause the formation of elongated aperture walls having decreasing thickness. If the holes are too close together, the integrity of the film may be destroyed either in the handling of the film or even in the puncturing process. Thus, the puncturing process limits the density of the openings in the film.

In contrast, the apertures in the film in accordance with the invention can have a much higher density, and the total open area can be much greater, with the result that liquids are absorbed through the film much more rapidly.

Another option in the composition of the absorbent core is to include an antimicrobial agent dispersed within the fibrous elements in an amount effective in controlling the proliferation of microorganisms such as *Salmonella choleraesius, Pseudomonas aeruginous,* and *Campylobacter jejuni.*

The presence of such microorganisms in a food-containing package is undesirable for several reasons. First, ingestion of contaminated food is life-threatening. Secondly, microorganisms may cause strong odors to develop within the package. Third, they can have undesirable effects on the taste of the food product.

Suitable antimicrobial agents include the carboxylic acid combinations disclosed in U.S. Pat. No. 4,865,855, dated Sep. 12, 1989. Preferred compositions for use in this invention include mixtures of citric, malic, benzoic tartaric, and sorbic acids; quaternary ammonium compounds containing $C_{12}$–$C_{18}$ alkyl substitutes. These antimicrobial agents can be incorporated into the absorbent core by conventional coating and impregnation techniques.

The presence of an effective antimicrobial agent in the absorbent core offers the additional benefits of control over the growth and proliferation of pathogens often associated with food products, in particular food products containing liquids, such as blood. These liquids are nutrients and may support the growth and proliferation and microorganisms, for example the range of Salmonella strains found in raw poultry products.

The use of three dimensional formed film in this invention prevents the migration of such antimicrobial agents from the core into the food product. While it is envisioned that only safe and non-toxic agents would be used, it is clearly an important objective to prevent migration of the agent from the absorbent core to the surface where the potential for contamination of the product exist.

The formed film of this invention provides a very high degree of liquid control, absorbing liquid on the film surface quickly through the apertures and into the capillary structure of the absorbent layer underneath. Once having absorbed liquid, the film surface is kept dry and relatively free of liquid reaching the surface via reverse flow.

While not wishing to limit the scope of the invention by theoretical explanations, the inventor believes that the principal driving force in the absorption of liquid is due to the capillary forces of the fibrous web in contact with the formed apertures, and that the formed apertures provide a relatively large cross-sectional area allowing rapid flow of liquid from the food products into the absorbent core. Although the apertures are relatively large, however, under an applied load, the absorbed liquids tend to exert hydraulic pressure on the thin aperture side walls to force them toward or into a closed condition. Thus, the apertures tend to have a large cross-sectional area initially, but close off when the absorbent core is wet. This phenomenon is believed to account for the surprising differences between the absorbent pad of the invention and the conventional absorbent pad.

As will be apparent from the foregoing description, the invention provides a package for liquid-containing foods such as meats, poultry, and fish, which controls the flow and accumulation of exuded liquids so that the liquids are physically and visually isolated from the food product. By virtue of the specially configured apertures, the absorbent pad has improved resistance to reverse migration of exudate outwardly from its absorbent layer. The improved performance of the absorbent pad allows the tray portion of the package to be formed from paperboard, which is environmentally superior to expanded polystyrene.

Various modifications can be made to the package described. for example, the core of the absorbent pad can be made from a layer of fluted paper positioned between two layers of polyethylene-coated paper in such a way that the coating side is in contact with the outer curves of the fluted paper. Upon exposure to heat, the coating is softened and the contact points are converted into adhesive bonds. Other modifications can be made without departing from the scope of the invention as defined in the following claims.

I claim:

1. A package containing a food product having a tendency to exude liquid, the package including an improved absorber comprising a core of absorbent material disposed between first and second layers made of substantially liquid-impervious material, the first layer being a film having an inner surface facing the core and an outer surface, and at least part of the first layer having a plurality of apertures with sidewalls projecting from the inner face toward the core, the sidewalls having terminating edges remote from said inner surface of the first layer and in contact with the core, the lengths of the sidewalls of the apertures being at least approximately five times the thickness of the first layer measured from its inner surface to its outer surface, whereby the apertures conduct liquid exuded by the food product to the absorbent core, and resist reverse flow of liquid from the core outwardly through the apertures.

2. A package according to claim 1 in which at least part of the outer surface of said first layer is in contact with the food product.

3. A package according to claim 1 in which the aperture sidewalls are formed by stretching the film.

4. A package according to claim 1 in which the aperture walls are formed by stretching the film with the application of heat.

5. A package according to claim 1 in which the second layer is a film free of apertures, and in which the outer surface of at least a part of the first layer having a plurality of apertures is in contact with the food product.

6. A package according to claim 1 in which the second layer is also a film having an inner surface facing the core and a plurality of apertures with sidewalls projecting from its inner surface toward the core, the sidewalls of the second layer having terminating edges remote from the inner surface of the second layer and in contact with the core.

7. A package according to claim 1 including a paperboard tray having a bottom wall, in which the second layer is free of apertures and located on one side of the core and in contact with the bottom wall of the tray, and the first layer is on the other side of the core and in contact with the food product.

8. A package according to claim 7 in which the second layer is adhesively fixed to the tray.

9. A package according to claim 1 in which the second layer is free of apertures and comprises paperboard, in which the second layer, the core of absorbent material and the first layer are laminated together and in the form of a die-cut sheet folded into a tray having a bottom and side walls with inwardly facing surfaces, and the first layer constitutes a liner defining the inwardly facing surface of the bottom and at least part of the inwardly facing surfaces of the side walls of the tray.

10. A package according to claim 1 in which the sidewalls of the apertures decrease in thickness in the direction away from the inner surface of the first layer from a thickness substantially the same as the thickness of the first layer, measured from its inner surface to its outer surface, to a thickness less than approximately 0.0005 inch.

11. A package according to claim 1 in which the apertures project into the core whereby portions of the absorbent material of the core extend into spaces between the apertures.

* * * * *